United States Patent [19]

Thatcher

[11] 3,987,727

[45] Oct. 26, 1976

[54] APPARATUS FOR SUPPLYING PRINTING INK TO A PRINTING UNIT

[75] Inventor: Richard E. Thatcher, Chesterfield, Va.

[73] Assignee: Philip Morris Incorporated, New York, N.Y.

[22] Filed: June 10, 1975

[21] Appl. No.: 585,672

[52] U.S. Cl. ..... 101/366; 222/327

[51] Int. Cl.[2] ..... B41F 31/02

[58] Field of Search ..... 101/366, 3, 4, 364; 222/327

[56] References Cited

UNITED STATES PATENTS

| | | | |
|---|---|---|---|
| 2,143,885 | 1/1939 | Kline | 101/366 |
| 2,943,768 | 7/1960 | Lindsay | 222/327 |
| 3,099,211 | 7/1963 | Hilgoe et al. | 101/366 X |
| 3,172,355 | 3/1965 | Freeman | 101/366 X |
| 3,321,108 | 5/1967 | Bowe | 101/366 |
| 3,326,123 | 6/1967 | Smalley | 101/366 |
| 3,345,943 | 10/1967 | Rakowicz et al. | 101/366 |
| 3,401,847 | 9/1968 | Downing | 222/327 |
| 3,752,368 | 8/1973 | Robertson | 222/327 |
| 3,880,331 | 4/1975 | Perkins | 222/327 |
| 3,882,772 | 5/1975 | Geisow et al. | 101/4 |

*Primary Examiner*—Edgar S. Burr
*Assistant Examiner*—Paul J. Hirsch
*Attorney, Agent, or Firm*—Watson Leavenworth Kelton & Taggart

[57] ABSTRACT

Apparatus for delivering printing ink from a tubular cannister filled with ink to a printing unit. The cannister is received in a tubular casing, and an air-operated plunger is forced through the cannister to feed ink from the cannister through a pipeline to a printing unit.

5 Claims, 2 Drawing Figures

APPARATUS FOR SUPPLYING PRINTING INK TO A PRINTING UNIT

BACKGROUND OF THE INVENTION

Various devices are known in the art for delivering heavy viscous materials, for example, grease caukling compound, printing ink and the like to a desired end point of use. It is also known to employ air pressurized cylinders to operate grease guns, caulking guns, pastry dough feeders and automatic machine lubrication systems. In the tobacco industry it is conventional to employ printing units for various purposes, among others, the printing of brand names on cigarette wrappers. It has been conventional in such cigarette manufacturing printing operations to supply ink to the printing unit from a supply cartridge or reservoir mounted on the printing unit. Such known arrangement has a number of drawbacks. For one thing, the cartridge has a limited capacity, being suited for use during only about one shift operation, i.e., for holding about eight hours of ink supply before the cartridge must be refilled. If only a single cartridge is used on the printing unit, it must temporarily be taken out of service to permit the cleaning of the cartridge and refilling of the same with a quantity of ink before it can be returned to the manufacturing line. If a plural supply cartridge system is employed, so that downtime or removal of the printing unit from the manufacturing line is not necessary, there still remains the task of cleaning an empty catridge and refilling of the same before it is available for further and future use. Further problems attending the use of known printing units employing reservoir or cartridge-type ink-holding means is caused by the entrapment of air in the ink mass during the refilling of the cartridge. Since the supply from the cartridge to the printing unit is in a closed system, ultimately such air will exit the system at the printing unit leading to the possibility of failure to print on cigarette wrappers during the time it takes for the air to escape from the printing unit. Since the ink used in the operation is a relatively thick material of grease-like consistency, it is difficult for the air to be removed by any other means than by expulsion through the printing unit.

Accordingly, it is desirable that a more effective, efficient and economical means of supplying printing ink to a printing unit in a cigarette manufacturing process line be provided.

SUMMARY OF THE INVENTION

The present invention is concerned with apparatus for delivering printing ink from a source thereof to a printing unit in a cigarette manufacturing operation, the printing ink being used for printing trade names on cigarette wrappers, printing cigarette package labels, etc. While the invention hereinafter will be described with particular reference to the employment of the same in connection with printing operations in a cigarette manufacturing operation, it will be understood that the invention has broader applicability and is intended for use in other types of printing operations wherein it is required to deliver printing ink at relatively constant rate to a printing unit without the need for removing the printing unit from service for a prolonged period or after a particularly short period of operation in order to replenish the supply of printing ink at the source thereof.

In accordance with the present invention, the apparatus for delivering printing ink from a source thereof, commonly a tubular cannister filled with said ink, to a printing unit comprises an elongated casing which is provided intermediate the ends thereof with a transverse barrier that divides the interior of the casing into first and second axially-disposed compartments. One end of the casing is provided with a removably connected capping plate to permit the insertion of an ink-filled tubular cannister coaxially into one of the compartments and also to permit removal of an empty cannister therefrom. Ink conveyance conduit means in the form of a pipeline extends from the capping plate to the printing unit and establishes communicative connection between the said one compartment and the printing unit, one end of the ink conveyance pipeline being connected to the printing unit and the other end carrying a connector which is rotatably relative to the pipeline, with the rotator being received in the capping plate. Thus the capping plate which desirably is connected to the casing by screw-threaded connection therewith can readily be removed from the casing without resulting application of twisting force to the ink conveyance pipeline.

A plunger is disposed in the said one compartment of the casing for sliding travel between a first operative position wherein the plunger is disposed in a position remote from the said one end of the casing to a second operative position wherein the plunger is disposed adjacent said one end of the casing. During travel of the plunger from its first to second operative positions, it moves through the ink-filled cannister and forces printing ink therefrom through the ink-conveyance pipeline to the printing unit, there being further provided means for stroking the plunger between its first and second operative positions at substantially constant rate of travel. The means for stroking the plunger can include a piston disposed in the second compartment of the casing for sliding travel therein with the piston having opposite side faces and being fixed to the plunger for unitary travel therewith, the piston being movable between first and second operative positions corresponding to those of the plunger. The piston in its first operative position is disposed adjacent the other end of the casing and its second operative position is remote from said casing other end with one side face of the piston being in communication with the said other end of the casing. Further a source of compressed air is provided and a compressed-air supply conduit means communicates air from the source to the said one face of the piston to stroke the piston and hence plunger from the first to second operative positions thereof with there also being provided means for maintaining the pressure of the air flowing from said source through the compressed air supply conduit means at a substantially constant level. Means are provided for retracting the plunger from its second to first operative position, such means being provided by connecting a second compressed air supply conduit means from said source to said casing at a location in which compressed air is communicated to the other face of the piston at a location which is more remote from said casing other end then that of said other face when the piston is in its second operative position. Thus at approximately the end of the forward or ink-feed stroking travel of the plunger, that is when the plunger has almost passed completely through the cannister so as to have emptied the same of printing ink, means can be operated to retract the plunger and hence permit replenishment of the first compartment with a filled cannister of ink.

Means also are provided for signaling when the ink-filled cannister is nearly empty. Such means are operable upon tavel of the plunger from its first operative position a predetermined distance toward its second operative position, such signaling means being provided in the form of a signal lamp in circuit with a pressure-sensitive switch. When the piston has moved in the second compartment from its first toward its second operative position the predetermined distance, air pressure in the second compartment which is used to drive the piston and hence the plunger from first to second position is passed from the second compartment to the pressure-sensitive switch to thereby energize the signal lamp.

Other features of the invention relating to plunger and casing configuration will appear later in the detailed description.

The invention accordingly advises the features of construction, combination of elements and arrangement of parts which will be exemplified in the construction hereinafter set forth and the scope of the invention will be indicated in the claims.

BRIEF DESCRIPTION OF THE DRAWING

A fuller understanding of the nature and objects of the invention will be had from the following description taken in conjunction with the accompanying drawing in which.

Throughout the following description like reference numerals are used to denote like parts in the drawing.

DESCRIPTION OF THE PREFERRED EMBODIMENT

Figure 1:
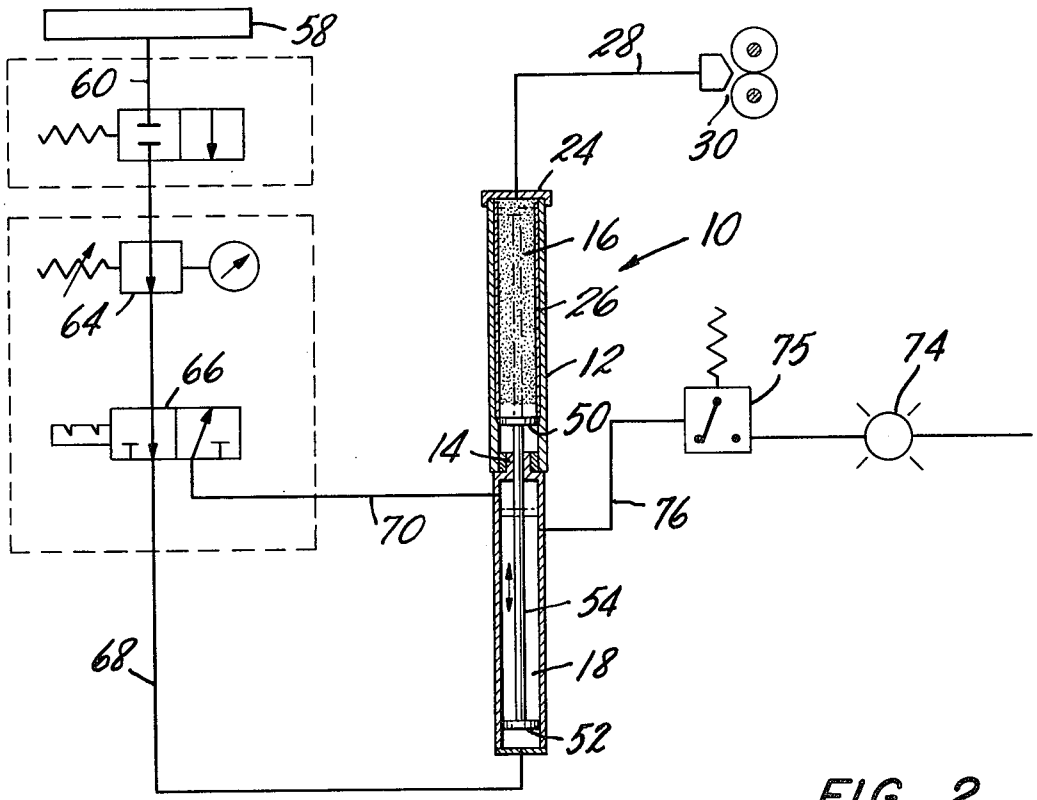
FIG. 1 is a schematic depiction of ink-supply apparatus constructed in accordance with the principles of the present invention, the plunger in the casing first compartment being shown in solid lines in its first operative position, the piston in the second compartment being in a correspondingly disposed first operative position, the respective plunger and piston components being shown in dashed lines in the second operative position of each.
Figure 2:
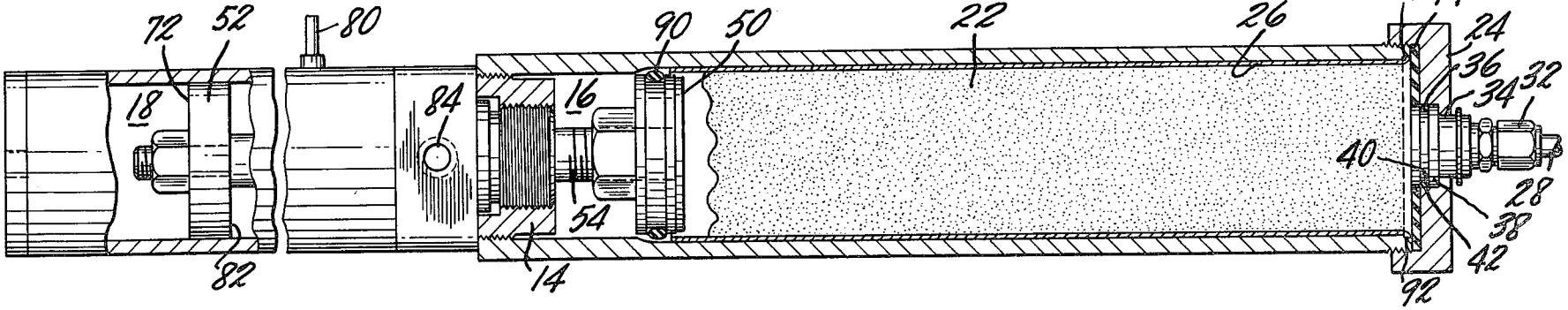
FIG. 2 is a longitudinal sectional view partly shown in full lines of the casing in which the ink filled cannister is received with portions of the second compartment casing being broken away to reveal constructional features of the second compartment and piston therein.

The present invention is directed generally to apparatus for supplying printing ink to a printing unit. It is described in a particular embodiment thereof as used in connection with supplying printing ink to a printing unit in a cigarette manufacturing operation wherein the printing unit is employed for printing brand names on cigarette wrappers and the like. Referring now to FIGS. 1 and 2 of the drawing, the apparatus 10 includes an elongated, e.g., hollow cylindrical casing 12 which in normal usage is disposed in vertical orientation, the casing 12 including a transverse barrier means 14 located intermediate the ends of the casing so as to define first and second axially disposed compartments 16 and 18 in the casing. The first compartment 16 in the casing 12 serves to receive a tubular cannister 20 filled with printing ink 22, the printing ink being a heavy relatively thick grease-like material. Connected to one end of the casing 12 as by screw thread connection is a removable capping plate 24, which capping plate can be removed to permit insertion of an ink-filled cannister 26 coaxially within compartment 16 and also for removal of the empty cannister following the expulsion of all ink therefrom. The apparatus also includes an ink conveyance conduit means or pipeline 28 which communicatively connects capping plate 24 and thus the cannister in compartment 16 to the printing unit 30. As can be best noted in FIG. 2 there is carried at one end of the ink pipeline 28 a swivel type connector 32 which is rotatable relative to the pipeline and is received in the capping plate, the capping plate being apertured and shouldered as at 34 and 36 for retention therein of the radially enlarged tip end portion 38 of the connector. Further the connector portion 38 includes a peripheral encircling slot 40 in which is received a O-ring 42 to provide a generally fluid tight seal around the region of passage of the connector through the capping plate. There also is received at the inner face of the capping plate 24, a sealing washer 44 of suitable resilient material which then the capping plate is threaded on the said one end of the casing forced into tight engagement with the annular end face of the casing to further seal the same and prevent removal of ink from the casing except through the intended course of communication of compartment 16 with the ink pipeline 28. For the purposes of forcing ink from the cannister 26 there is disposed in compartment 16 a plunger 50 which is supported such as to be slideable from a first operative position wherein it is remote from the said casing one end as shown in full lines in FIG. 1 and 2 to a second operative position wherein the plunger is disposed in a position adjacent said one end (phantom lines), the plunger during its travel from first to second operative positions moving through the cannister 26 to force printing ink 22 therefrom into the ink conveyance conduit 28.

For the purposes of stroking the plunger between its first and second operative positions at a substantially constant rate of travel, i.e., to pump ink at substantially uniform rate to the printing unit, there is provided in the other compartment 18 of casing 12 a piston 52 which is fixed to the plunger for unitary travel therewith as by connecting rod 54, and like plunger 50 being movable between first and second operative positions, the first operative position of the piston 52 being shown in full lines in FIG. 1 and its second operative position in dashed or phantom lines. In the first operative position of the piston 52, it is disposed adjacent the other end of casing 12 and in its second operative position is disposed remote from said other end of the casing. The stroking means also includes a source 58 of compressed air which can be a receiver supplied by a compressor (not shown), the compressed air in the receiver being present at a relatively high pressure of certain value, for example, about 80 psig. Air from the source 58 flows through a suitable conduit 60 and through a two-way solenoid valve 62, a pressure reducer and regulator unit 64 wherein the pressure is reduced to a lower and relatively constant pressure level, for example, a pressure which is one within a range of about 20 to 25 psig. with the air thereafter flowing through a selectively positionable valve means 66 which according to the orientation thereof will provide compressed air flow through one or the other of the compressed air supply conduits 68 or 70 for the purposes as will appear more fully shortly. If the compressed air flows through conduits 68 which is connected to the said other end of the casing 12 and thus communicated through the casing end to one face 72 of piston 52, the piston will be displaced from its first to second operative positions and concurrently the plunger will move through a travel stroke for forcing ink from the cannister 26.

In order to inform the printing unit operator of the emptying of the cannister 26, there is provided visual signal indicator means 74 which is actuated to signal such event, i.e., to indicate the travel of the plunger a predetermined position from its first toward its second operative positions, such travel of the plunger being one as represents a nearly empty condition of the cannister. The visual signal indicator means 74 is controlled by a pressure-sensitive device 75, e.g., a switch which is in circuit with the indicator 74 and in turn is controlled by the imposition of pressure thereon as by a flow of air pressure through the air pipeline 76. Air pipeline 76 is located in communicative connection with the second compartment 18, communicative entry to the casing 12 at a location therein which is intermediate the casing other end and the said one face 72 of the piston when the piston is in its second operative position. Thus as is noted in FIG. 1 when the plunger and hence piston have moved to their second operative positions, the piston 52 has passed by the port 80 through which pipeline 76 communicates with compartment 18. Accordingly, air flowing into compartment 18 from conduit 68 will pass through the air pipeline 76 and operate the pressure sensitive control device 75 to operate the visual signal indicator 74.

As indicated above, the selectively positionable valve 66 can be oriented between either of two positions to cause stroking of the plunger 50 or retraction of the same at the end of the ink conveyance operation, that is after a cannister has been depleted of the ink therein and it is desired to replenish the ink supply by insertion of a new cannister in the casing. For this purpose the selectively positionable valve 66 can upon operation of visual signal indicator be positioned by an operator to divert air from source 58 through the compressed air conduit line 70. Thus, air will flow into compartment 18 and against the other face 82 of piston 52. The communicative connection of conduit 70 into compartment 18 is more remote from the said other end of the casing than that of piston face 82 when said piston is in its second operative position, connection being at port 84. This action then will cause the piston and hence plunger to move downwardly as seen in FIG. 1 to return it to its first operative position.

As can be seen in FIG. 2, the plunger 50 which has a disc-like body is provided at the periphery thereof with a ring 90 of resiliently deformably material with the ring deforming against the cannister inner surface during movement of the plunger therethrough to provide a seal between the cannister and plunger and thus prevent forced conveyance of ink from the cannister in a direction counter to the direction of plunger travel.

It will be understood that the ink cannister is a device known in the art and can be provided in various shapes so that the inner surface configuration of the casing 12 will conform with the outer surface configuration of the cannister to suit a particular situation, e.g., casing cylindrical inner surface in correspondence to a cannister cylindrical outer surface. Furthermore, the said one end of the casing is provided with an annular shouldered end face to define a stop abuttment 92 for engaging a peripheral bead 94 on the end of the cannister to limit the entry of the cannister into compartment 16. The plunger 50 also conforms with the innner surface of the cannister, most conventionally being cylindrical like the cannister and casing.

It will be noted that the ink-filled cannister 26 is of known character and for shipment and handling prior to actual usage is provided with closures at both ends thereof. Obviously such closures are removed prior to insertion of the cannister in compartment 16.

It will be noted too that various modifications can be made in the disclosed invention. For example, if it is desired to accelerate initial discharge of ink from the filled cannister to the pipeline 28, a bypass line can be provided directly connecting receiver 58 with conduit 68. Upon commencement of sufficient flow at the printing unit, the air flow can then be directed through the regulator 64 and valve 66.

The present invention offers a number of advantages over the prior art devices employed for supplying printing ink to a printing unit. Principal among these is the fact that replenishment of the ink supply need only be effected, for example, as relating to the particular tobacco manufacturing printing operation enumerated earlier, once every 60 shifts as compared to once each shift as heretofore practiced.

It will thus be seen that the objects set forth above among those made apparent from the foregoing description are efficiently attained and, since certain changes in the construction set forth which embody the invention may be made without departing from its scope, it is intended that all matter contained in the above description shall be interpreted as illustrative and not in a limiting sense.

What is claimed is:

1. Apparatus for delivering printing ink from a tubular cannister filled with said ink to a printing unit which comprises an elongated casing, there being means in said casing intermediate the ends thereof for dividing the interior of said casing into first and second axially disposed compartments, a capping plate, said capping plate being removably connected to one end of said casing whereby an ink filled tubular cannister can be insertably received coaxially within one of said compartments and removed therefrom when empty, ink conveyance conduit means extending from said capping plate to said printing unit and communicatively connecting said one compartment with said printing unit, a plunger disposed in said one compartment of said casing for sliding travel between a first operative position wherein said plunger is disposed in a position remote from said casing one end to a second operative position wherein said plunger is disposed in a position adjacent said one end and vice versa, said plunger during travel from said first to said second operative positions thereof moving through said cannister and forcing printing ink therefrom through said ink conveyance conduit means, means for stroking said plunger between its first and second operative positions at substantially constant rate of travel, said stroking means comprising a piston disposed in the other of said casing compartments for sliding travel therein, said piston having opposite side faces, said plunger being fixed to said piston for unitary travel therewith, said piston being movable between first and second operative positions corresponding to those of said plunger, said piston in its first operative position being disposed in a position adjacent the other end of said casing and in its second operative position remote from said casing other end, one of the side faces of said piston being in communication with the said other end of said casing, a source of compressed air, compressed air supply conduit means for communicating compressed air from said source to said one face of said piston, and a regulator for maintaining the pressure of the air flowing from said source through said compressed air supply conduit means at substantially constant level, and means for retracting said plunger from its second to first operative positions, said retracting means comprising second compressed air supply conduit means for communicating compressed air from said source to the other face of said piston.

2. The apparatus of claim 1 in which said second compressed air supply conduit means is communicatively connected with the other of said casing compartments at a location therein which is more remote from said casing other end than that of the said other face of said piston when said piston is in its second operative position, both said compressed air supply conduit means and said second compressed air supply conduit means being connected with a selectively positionable valve means intervening both said conduit means and said source of compressed air for selectively supplying compressed air to stroke or retract said plunger.

3. The apparatus of claim 1 further comprising means operable upon travel of said plunger from its first operative position a predetermined distance toward its second operative position for signalling such event.

4. The apparatus of claim 3 in which said signalling means includes a visual indicator, a pressure sensitive device for controlling operation of said visual indicator, and means for imposing a pressure on said device when said plunger has travelled said predetermined distance.

5. The apparatus of claim 4 in which said means for imposing pressure on said device comprises an air pressure supply line connected at one end to said device and at its other end to said casing in communicative connection with the said other compartment therein at a location which is intermediate the said other end of said casing and the said one face of said piston when said plunger has travelled said predetermined distance whereby compressed air from said source flows through said air pressure supply line.

* * * * *